United States Patent [19]

Vilutis

[11] Patent Number: 4,558,801

[45] Date of Patent: Dec. 17, 1985

[54] CONFORMING LINER

[75] Inventor: Leonard J. Vilutis, Frankfort, Ill.

[73] Assignee: Vilutis & Co., Inc., Frankfort, Ill.

[21] Appl. No.: 639,130

[22] Filed: Aug. 9, 1984

[51] Int. Cl.[4] ..... B65D 5/56; B65D 25/14

[52] U.S. Cl. ..... 220/404; 220/462; 220/470; 383/107; 383/113; 383/119; 426/124; 426/130; 426/411

[58] Field of Search ..... 220/404, 462, 463, 470; 383/107, 108, 119, 120, 121, 109, 101, 113, 44; 426/411, 124, 130

[56] References Cited

U.S. PATENT DOCUMENTS

| | | | |
|---|---|---|---|
| 1,941,871 | 1/1934 | Struve | 220/404 X |
| 2,298,419 | 10/1942 | Salfisbers | 383/119 X |
| 2,429,538 | 10/1947 | Wood | 383/107 X |
| 2,932,575 | 4/1960 | Scion et al. | 426/130 |
| 2,998,340 | 8/1961 | Conway | 493/100 X |
| 3,142,437 | 7/1964 | Grant et al. | 383/107 X |
| 3,262,629 | 7/1966 | Murphy et al. | 220/462 X |
| 3,969,995 | 7/1976 | Kruesev et al. | 426/130 X |
| 3,987,959 | 10/1976 | Deards et al. | 383/119 X |
| 4,269,247 | 5/1981 | Omdal | 383/8 |
| 4,478,351 | 10/1984 | Homma | 220/462 |

FOREIGN PATENT DOCUMENTS

| | | | |
|---|---|---|---|
| 1307516 | 9/1962 | France | 383/44 |
| 1436135 | 3/1966 | France | 383/121 |

*Primary Examiner*—Allan N. Shoap

*Attorney, Agent, or Firm*—Lockwood, Alex, Fitzgibbon & Cummings

[57] ABSTRACT

A film liner is provided in the form of a sleeve having a conforming seal area provided on the sleeve that joins opposing panels of the sleeve along a location that is spaced inwardly from an edge of the sleeve, and this conforming seal area has a length that is less than the length of the edge from which it is inwardly spaced. When the conforming liner according to this invention lines a container, such as a cheese-making box, the mouth of this liner forms a cuff over the peripheral edge of the container. When thus used, the interior surface including the conforming seal area of the liner provides a relatively flat, crevice-free surface for receiving cheese curd or like products, and excess paneling material is positioned underneath this conforming interior surface and out of contact with the product filling the container.

15 Claims, 7 Drawing Figures

FIG. 1
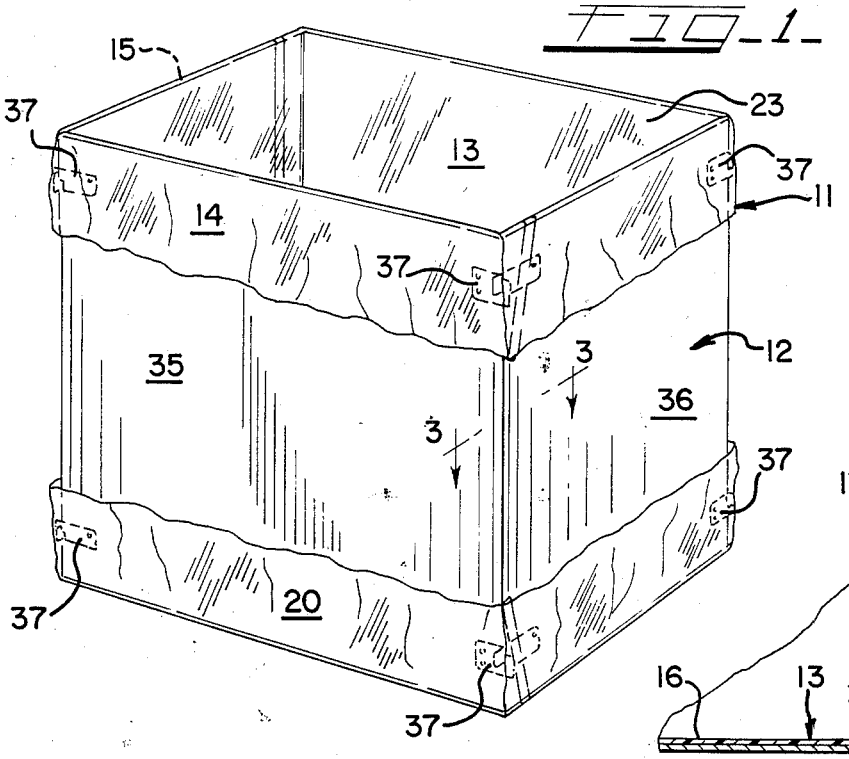
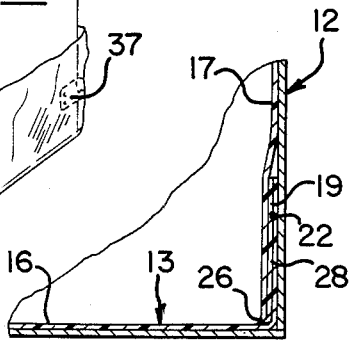
FIG. 3
FIG. 2
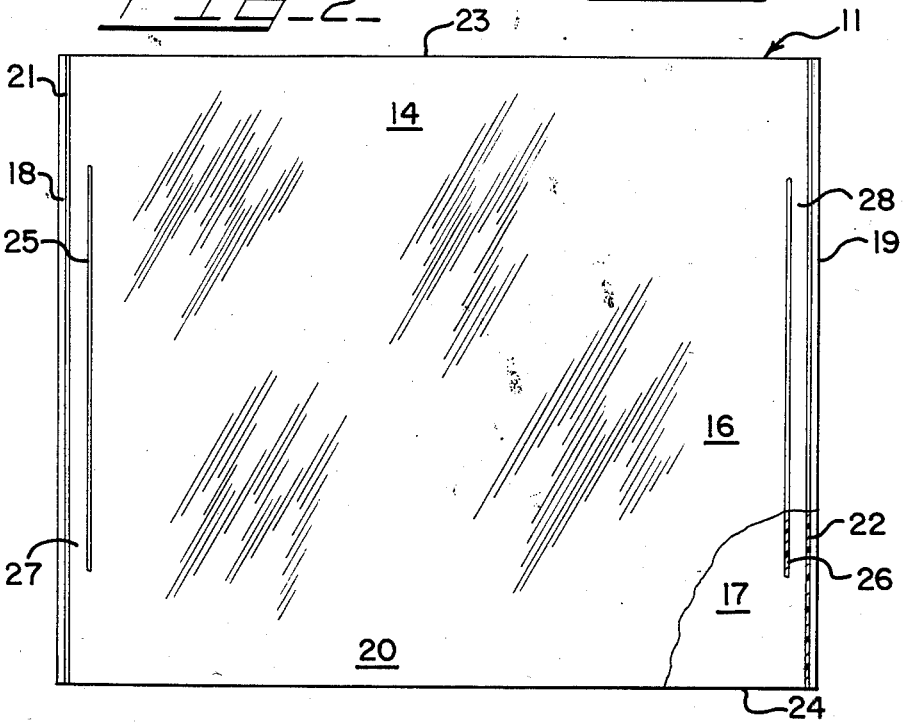

CONFORMING LINER

BACKGROUND AND DESCRIPTION OF THE INVENTION

This invention generally relates to liners for containers, more particularly to flexible liners that closely conform to the inside walls of self-supporting containers. Such conforming liner includes a conforming seal having a length substantially the same as the height of the vertical walls of the container, which conforming seal is spaced inwardly from an edge of the liner. When the liner is installed within the container, the edge of the liner remains between the liner and the container, except for a portion thereof which extends beyond the conforming seal and that is folded over to form a cuff portion which overlies a peripheral edge defining the mouth of the container.

Utilization of flexible liners for providing readily releasable surfaces along the inside panels of free-standing containers has been well-known for many years. Included is the use of open-mouth polymeric film liners or bags for providing a continuous inner surface for boxes of various products, including chemicals, foods and other products, wherein the liner provides a layer of material along the inside surface of the container, box or the like. A particular application along these lines is in connection with cheese-making operations. Many cheese products are made within large containers, generally known as "Toska boxes" which are designed to provide a bulk cheese-making container to make a block of cheese weighing approximately 640 pounds.

Generally speaking, a Toska box type of container is a four-sided wooden or metal sleeve. With cheesecloth enclosing the bottom of this structure, cheese curd is poured into the box, and the whey is pressed from the curd and through the cheesecloth. The open top of the box or container is then closed with a suitable lid, and the thus closed container is stored or shipped for further processing and/or packaging. After the cheese has set for the desired length of time, the walls of the container or box are separated from each other and from the cheese that has set therewithin. At this stage, it is important that the walls of the container or box be flat and adequately releasable from the set cheese so that the cheese block will have sides that are relatively smooth and undamaged. Traditionally, such releasability had been provided by waxing the inside walls of the container or box, but this procedure is quite labor intensive. In more recent years, the wax has been replaced by a flexible film liner.

Widely used flexible film liners in this regard take the form of cyindrical film sleeves or tubes that generally line the inside surface of the container or box. These types of sleeve liners have a height that is somewhat greater than the height of the container or box, whereby the sleeve is folded over a mouth-defining peripheral edge of the container and over a portion of an outside surface of the container in order to form a liner cuff or overlap that is several inches in length and that assists in holding the liner in place. Usually, this cuff arrangement is provided on both the top periphery and the bottom periphery of the container or box.

The principal difficulty with these generally cylindrical sleeve or tube liners is that, in order to provide enough film to permit liner fold over and cuff formation, the perimeter of the sleeve is greater than the inside perimeter of the container or box. As a result, in the case of cheese making, before the cheese curd is poured into the box, the worker must carefully fold the liner so that its excess perimetrical film material will lie flat against the inside surface of the box while, and hopefully after, the cheese curd is filled into the container or box. This is exceedingly difficult to accomplish due to the flexibility of the liner material and the shifting thereof that occurs while the curd is poured into the box and up against the liner. If, as is all too often the case with these types of liners, the cheese curd flows into pockets formed in the liner by the excess perimetrical film material, the set cheese will likewise form within these pockets. When the liner is removed for subsequent processing, cutting and/or packaging of the cheese block, a portion of the cheese block at or in the vicinity of these pockets often breaks away thereby losing cheese weight and damaging the appearance of the cheese block and reducing the total yield of commercially acceptable product that is obtained from each block when it is cut into smaller blocks.

One advantage of these prior art liners is that they are relatively inexpensive because of their substantially simple construction. Inexpensiveness is an important attribute and necessary feature of these types of liners inasmuch as they are not reused and are looked upon as a disposable item that cannot be particularly elaborate or expensive to manufacture.

Accordingly, there is a need for an inexpensive liner that is easily installed and maintained in position within a container or box, even when the container or box is being filled with a flowable material such as cheese curd and the like. Such needs are satisfied by the present invention which provides a liner having an inside surface that substantially conforms to the inside surface of the container or box being lined while still providing a mouth-defining portion having a periphery that is oversized to permit the formation of a cuff portion for folding over the lip of the box.

These desirable features and advantages are accomplished according to the present invention by providing a conforming liner that is a sleeve-like member having a cuff portion periphery which is greater than the periphery of the inside of the container or box to be lined and which conforming liner further includes a conforming seal area that seals a length of the sleeve-like member together at a location that is spaced from an edge of the cuff portion periphery and that has a length which is substantially the same as the height of the container or box being lined. The conforming seal area is spaced inwardly by an amount such that the inner periphery of the sleeve that includes the conforming seal area in its definition is substantially the same as or somewhat less than the inner periphery of the container or box. A plurality, preferably two, of such conforming seal areas may be provided.

It is accordingly a general object of the present invention to provide an improved liner for a container or box.

Another object of this invention is to provide an improved liner that generally conforms to the inside dimensions of a container or box while including an extraordinarily sized peripheral edge portion that readily forms a cuff which overlies the peripheral edge of the container or box.

Another object of the present invention is to provide a conforming liner that is inexpensive and that requires minimal effort to install and to maintain in place during filling of a box or container within which it is inserted.

Another object of the present invention is to provide an improved conforming liner wherein the liner includes excess material which is maintained behind a inside surface of the conforming liner that is sized to be substantially the same as the inside surface of the container or box.

These and other objects of this invention will be apparent from the following detailed description thereof, taken in conjunction with the accompanying drawings, wherein:

FIG. 1 is a perspective view of the preferred embodiment of the conforming liner according to this invention, shown assembled onto a container or box;

FIG. 2 is a plan view, partially broken away, of the conforming liner of FIG. 1, shown in a flattened or collapsed condition;

FIG. 3 is a sectional view along the line 3—3 of FIG. 1;

Figure 4:
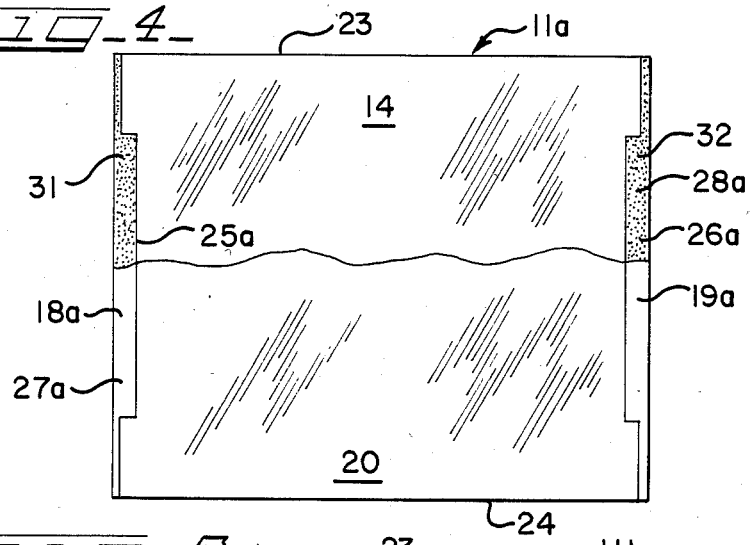
FIG. 4 is a plan view, partially broken away, of an alternative embodiment of a collapsed liner according to this invention.

A conforming liner, generally designated as 11, is illustrated in FIG. 1 installed within a box or container, generally designated as 12. Conforming liner 11 includes an interior lining surface 13 and cuff portions 14. The interior lining surface 13, when the liner 11 is installed as shown in FIG. 1, generally conforms to the shape and dimensions of the interior walls of the container 12, while each cuff portion 14 extends from the interior lining surface 13 and folds over a lip or peripheral edge 15 of the box or container 12 so as to generally overlie a portion of the outside surface of the box or container 12 that is adjacent to the peripheral edge 15.

With more particular reference to the conforming liner 11, FIGS. 1 through 3 illustrate the preferred embodiment thereof in a collapsed or generally flattened condition prior to installation. Included are opposing panels 16 and 17 which are of generally equal length and height. Opposing panels 16 and 17 ar joined together along opposing edges 18 and 19 thereof, such joined-together edges 18 and 19 having been energy sealed together when the opposing panels 16 and 17 are in the overlying relationship generally illustrated in FIG. 2. In this embodiment, the joined-together opposing edges 18 and 19 each include a seal line 21, 22. An unsealed mouth 23 extends between and is defined by the joined-together opposing edges 18 and 19. Cuff portion 14 is partially defined by the lip of the unsealed mouth 23, and this embodiment includes another unsealed mouth 24 and cuff portion 20.

A conforming seal 25, 26 is spaced inwardly of each of the joined-together opposing edges 18, 19. Additionally, the conforming seals 25, 26 each have a length that is less than the height of the panels 16, 17 and in this embodiment also less than the length of the joined-together opposing edges 18, 19. This shorter length is positioned such that the conforming seals 25, 26 assist in defining the cuff portions 14, 20. Conforming seals 25, 26 define the perimeter and height of the interior lining surface 13 to be substantially the same as the perimeter and height of the interior walls of the box or container 12.

Because of this structure, when the conforming liner 11 is installed within the box or container 12 as shown in FIG. 1, the interior lining surface 13 is readily positioned to closely conform in size and shape to the size and shape of the interior walls of the box or container 12. In this regard, it is particularly important to note that any excess paneling materials, including surplus film sections 27, 28, that are located outwardly of the conforming seals 25, 26 will, when installed, remain between the conforming liner 11 and the walls of the box or container 12. Materials such as cheese curd and the like that are filled into the thus lined box or container 12 will contact only the interior lining surface 13 of the conforming liner and will not contact surplus film sections 27, 28 to thereby provide a substantially smooth and uncreviced surface for contacting the product materials filled into the box or container 12.

The periphery of the interior lining surface 13, which is twice the distance between the conforming seals 25 and 26, may be somewhat less than the interior periphery of the box or container 12, especially if the film out of which the conforming liner 11 is made is a stretchable or somewhat elastomeric material. It is preferred that two conforming seals 25 and 26 be provided as shown in order to distribute the film of the cuff portions 14, 20 generally uniformly throughout the peripheral extent of the cuff portions 14, 20 so that each cuff portion 14, 20 can be easily folded and will be substanially consistently shaped and sized after it is formed over the peripheral edge or lip 15 of the box or container 12.

In the alternative embodiment illustrated in FIG. 4, the conforming liner **11*a* is similar to conforming liner 11 of FIGS. 1 through 3, except the respective seal lines at the joined-together opposing edges 18*a*, 19*a* extend to the conforming seals 25*a*, 26*a* in order to form a seal area 31, 32 that generally includes the surplus film sections 27*a*, 28*a***.

Figure 5:
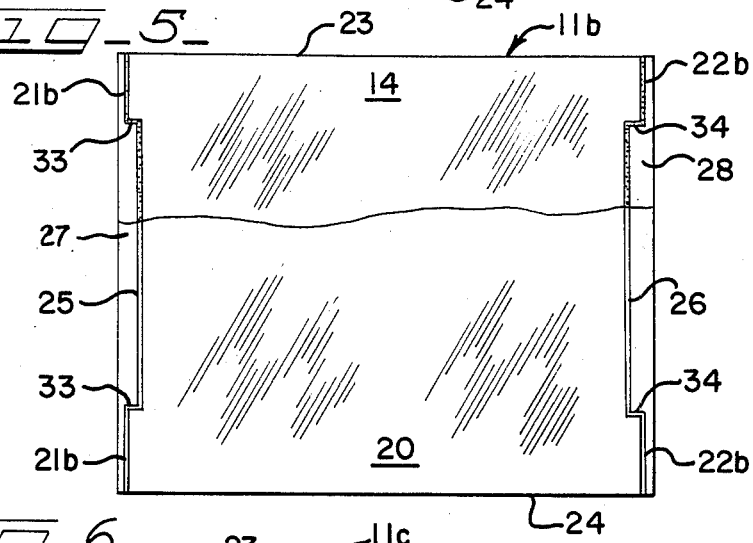
FIG. 5 is a plan view, partially broken away, of another alternative embodiment of a collapsed liner according to this invention.

FIG. 5 illustrates a further embodiment of a conforming liner **11*b*. In this conforming liner 11*b*, the conforming seals 25, 26 are substantially the same as shown on conforming liner 11. Joining seals 33, 34 generally connect the respective conforming seals 25, 26 with respective seal lines 21*b*, 22*b* which extend from the respective joining seals 33, 34 to one of the unsealed mouths 23, 24. Seal lines 21*b*, 22*b* join the film panels of the cuff portions 14, 20 so that the cuff portions 14. 20 remain in place in their folded-over installed position as shown in FIG. 1. Analogous features are provided in all of the embodiments illustrated herein so that the folded over cuff portions 14, 20** remain in place without the need for holding or tying members such as elastomeric bands.

Figure 6:
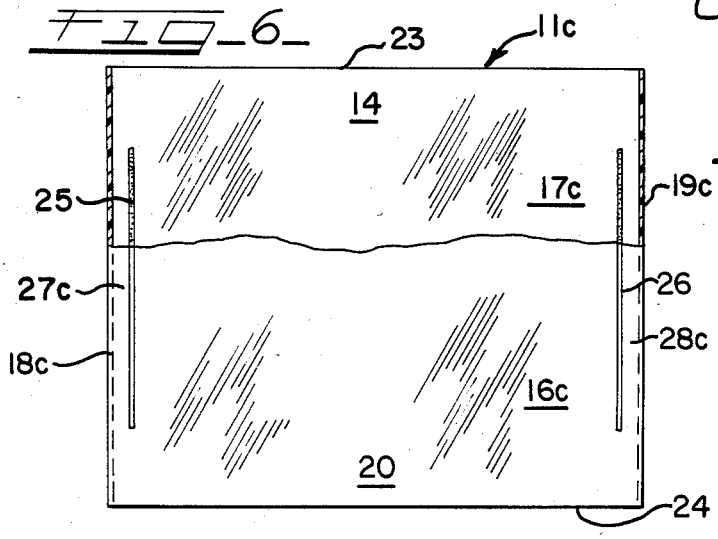
FIG. 6 is a plan view, partially broken away, of a further alternative embodiment of a collapsed liner according to this invention.

The embodiment of the conforming liner **11*c* that is shown in FIG. 6 includes joined-together opposing edges 18*c*, 19*c* which are integral sections of a tube or sheath that had been formed by blow molding or the like. When the conforming liner 11*c* is generally collapsed as illustrated in FIG. 6, opposing panels 16*c*, 17*c* are defined between the joined-together opposing edges 18*c*, 19*c*. Surplus film sections 27*c*, 28*c* include those portions of the tube or sheath that are spaced outwardly of the conforming seals 25, 26**.

Materials out of which the conforming liner according to this invention is made will be selected in order to provide the properties needed for the particular intended use of the conforming liner. For example, when an oxygen barrier film is needed, which would typically be the situation in connection with the making of aged cheese, a multi-layered barrier film would be used. Exemplary of this type of multi-layered film is Saranex film (trademark of The Dow Company). Usually, these multi-layered film materials are three ply or five ply. For example, a crystalline copolymer of vinylidene chloride and vinyl chloride, the polymer being known as saran, can be integrally sandwiched between outer layers of low density polyethylene, which layers are typically extruded as a single film. The internal, sandwiched layer in this type of film is a high fluid barrier film, which is sandwiched between and protected by tough, extensible polyethylene films, often with an ethylene vinyl acetate film between the center film and both of the outer layers. These multi-layered films are especially useful since they are approved for use in connection with food and drug products.

When an oxygen barrier film is not needed, for example in connection with the making of cheese products that are not of the aged variety, the conforming liner may be as simple as to be made of single layered sheets such as those of polyolefins including polyethylene, polypropylene and the like, whether of low, medium or high density. Also suitable, depending upon the intended use of the conforming liners, are films made of materials such as ethylene vinyl acetate copolymers, polyamides, modified polymers such as polyethylene modified with polyisobutylene, coextrusions of a polyolefin and ethylene vinyl acetate, polyethylene teraphthalates, Surlyn tubing, and the like.

Figure 7:
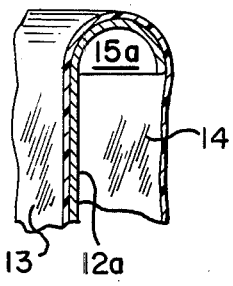
FIG. 7 is a sectional view of a top portion of a conforming liner according to this invention, shown assembled over a container having a rolled top peripheral edge.

With more particular reference to the preferred use of the conforming liners 11, 11*a*, 11*b*, 11*c* in conjunction with cheese making operations, the box or container 12 is a container such as the wooden Toska box illustrated in FIG. 1, which includes four panels 35, 36 that are temporarily joined together by latches 37. After the cheese has been set, the latches 37 are opened, to thereby expose the outside surface of the conforming liner. FIG. 7 illustrates a known alternative box or container 12*a* made of a material such as stainless steel in which the peripheral lip 15*a* is generally curved or beaded.

A typical cheese making container or box for making a 640 pound block of cheese has a height of 28 inches, and has a periphery defined by a length of 28 inches and a width of 22 inches. In other words, panels 35 would be 28 inches by 28 inches, and panels 36 would be 22 inches by 28 inches. Accordingly, the conforming liner according to this invention when used for lining such a box would have conforming seal lines 25, 26, 25*a*, 26*a* that are each approximately 28 inches long (conforming to the height of the box or container 12). Such a conforming liner has an interior lining surface 13 that has a total periphery of approximately 100 inches (twice the interior length of the box plus twice the interior width of the box), and the spacing between the conforming seal 25, 25*a* and the conforming seal 26, 26*a* is approximately 50 inches.

It is to be appreciated that this invention can be embodied in various forms and therefor is to be construed and limited only by the scope of the appended claims.

I claim:

1. A conforming liner, comprising:

one panel of film material having a selected length and a selected height;

another panel of the film material having a length and a height substantially the same as the respective selected length and selected height of said one panel of film material;

said panels of film material having joined-together opposing edges thereof to form a sleeve-like member having an unsealed mouth;

a conforming seal spaced inwardly from at least one of said joined-together opposing edges, said conforming seal sealing a section of said one panel to an opposing section of said another panel and having a length that is less than said selected height of said panels of film material;

another conforming seal spaced inwardly from another of said joined-together opposing edges, said another conforming seal seals another section of said one panel to an opposing section of said another panel, said another conforming seal has a length that is less than said selected height of said panels of film material;

a cuff portion that extends in one direction between said joined-together opposing edges, and said cuff portion extends in another direction from approximately an end of each of said conforming seals to said unsealed mouth, said cuff portion being substantially free of said conforming seals and said conforming seals are spaced apart by a distance that is not greater than approximately one-half of an inside periphery of a self-supporting container to be lined with said conforming liner.

2. The conforming liner according to claim 1, further including another unsealed mouth and another cuff portion that extends in said one direction between said joined-together opposing edges, and said another cuff portion extends in another direction from approximately an opposite end of said conforming seal to said another unsealed mouth said another cuff portion being substantially free of said conforming seals.

3. The conforming liner according to claim 1, wherein said joined-together opposing edges each include an energy-sealed line.

4. The conforming liner according to claim 1, further including an energy-sealed area that extends from said joined-together opposing edge to said conforming seal.

5. The conforming liner according to claim 1, further including a joining seal that generally connects an end of said conforming seal to said joined-together opposing edge from which the conforming seal is inwardly spaced.

6. The conforming liner according to claim 1, wherein said joined-together opposing edges are integral sections of said sleeve-like member.

7. A conforming liner for lining an inside surface of a self-supporting container having a plurality of joined vertical container walls, each said wall having a predetermined length, all of the container walls having approximately the same predetermined height, the conforming liner comprising:

one panel of film material having a selected length and a selected height that is greater than the predetermined height of the container walls;

another panel of the film material having a length and a height substantially the same as the respective selected length and selected height of said one panel of film material;

said panels of film material having joined-together opposing edges thereof to form a sleeve-like member having an unsealed mouth;

a conforming seal spaced inwardly from at least one of said joined-together opposing edges, said conforming seal sealing a section of said one panel to an opposing section of said another panel and having a length that is less than said selected height of said panels of film material, said length of the conforming seal also being approximately equal to the predetermined height of the container walls;

another conforming seal spaced inwardly from another of the joined-together opposing edges, said another conforming seal seals another section of said one panel to an opposing section of said another panel, said another conforming seal having a length substantially equal to the length of said conforming seal;

a cuff portion that extends in one direction between said joined-together opposing edges, and said cuff portion extends in another direction from approximately an end of each of said conforming seals to said unsealed mouth said cuff portion being substantially free of said conforming seals; and a lining surface of the conforming liner, said lining surface excludes said cuff portion and includes said conforming seals, and said lining surface is uncreviced and closely conforms to the size and shape of the self-supporting container.

8. The conforming liner according to claim 7, further including another unsealed mouth and another cuff portion that extends in said one direction between said joined-together opposing edges, and said another cuff portion extends in another direction from approximately an opposite end of said conforming seal to said another unsealed mouth said another cuff portion being substantially free of said conforming seals.

9. The conforming liner according to claim 7, wherein said conforming seals are spaced apart by a distance that is not greater than approximately one-half of the total of the predetermined lengths of the container walls.

10. The conforming liner according to claim 7, wherein said cuff portion is foldable to closely overlie an external lip portion of the self-supporting container.

11. In combination, a conforming liner installed within and lining an inside surface of a self-supporting container having a plurality of joined vertical container walls, each said wall having a predetermined length, all of the container walls having approximately the same predetermined height, the conforming liner comprising:

one panel of film material having a selected length and a selected height that is greater than the predetermined height of the container walls;

another panel of the film material having a length and a height substantially the same as the respective selected length and selected ehight of said one panel of film material;

said panels of film material having joined-together opposing edges thereof to form a sleeve-like member having an unsealed mouth;

a conforming seal spaced inwardly from at least one of said joined-together opposing edges, said conforming seal sealing a section of said one panel to an opposing section of said another panel and having a length that is less than said selected height of said panels of film material, said length of the conforming seal also being approximately equal to the predetermined height of the container walls;

another conforming seal spaced inwardly from another of the joined-together opposing edges, said another conforming seal seals another section of said one panel to an opposing section of said another panel;

a cuff portion that extends in one direction between said joined-together opposing edges, and said cuff portion extends in another direction from approximately an end of each of said conforming seals to said unsealed mouth said cuff portion being substantially free of said conforming seals; and a lining surface of the conforming liner, said lining surface excludes said cuff portion and includes said conforming seals, and said lining surface is uncreviced and closely confroms to the size and shape of the self-supporting container.

12. The combination according to claim 11, said another conforming seal having a length substantially equal to the length of said conforming seal.

13. The combination according to claim 11, further including another unsealed mouth and another cuff portion that extends in said one direction between said joined-together opposing edges, and said another cuff portion extends in another direction from approximately an opposite end of said conforming seal to said another unsealed mouth, said another cuff portion being substantially free of said conforming seals.

14. The combination according to claim 11, wherein said conforming seals are spaced apart by a distance that is not greater than approximately one-half of the total of the predetermined lengths of the container walls.

15. The combination according to claim 11, wherein said cuff portion is foldable to closely overlie an external lip portion of the self-supporting container.

* * * * *